US006390785B1

(12) United States Patent
Sheyman et al.

(10) Patent No.: US 6,390,785 B1
(45) Date of Patent: May 21, 2002

(54) HIGH EFFICIENCY BOOSTER FOR AUTOMOTIVE AND OTHER APPLICATIONS

(75) Inventors: Vladimir Sheyman, West Bloomfield; Mulchand S. Rathod, Grosse Pointe Woods, both of MI (US)

(73) Assignee: The Board of Governors of Wayne State University, Detroit, MI (US)

( * ) Notice: Subject to any disclaimer, the term of this patent is extended or adjusted under 35 U.S.C. 154(b) by 0 days.

(21) Appl. No.: 09/679,673

(22) Filed: Oct. 5, 2000

(51) Int. Cl.[7] ..... F04B 35/00
(52) U.S. Cl. ..... 417/225; 60/533
(58) Field of Search ..... 417/225, 53, 344, 417/246, 342; 123/46 R; 60/560, 533, 57 R; 91/459

(56) References Cited

U.S. PATENT DOCUMENTS 3,693,351 A * 9/1972 Minkus ..... 60/57 R
4,470,771 A * 9/1984 Hall et al. ..... 417/342
4,767,282 A * 8/1988 Igarashi et al. ..... 417/225
4,784,579 A * 11/1988 Gazzera ..... 417/246
5,222,873 A * 6/1993 Whitehead et al. ..... 417/344
5,297,382 A * 3/1994 Waltonen et al. ..... 60/533
5,353,685 A * 10/1994 Snow ..... 91/459
5,649,424 A * 7/1997 Valavaara ..... 60/560
5,879,137 A * 3/1999 Yie ..... 417/225
6,158,967 A * 12/2000 Dupre ..... 417/53
6,293,231 B1 * 9/2001 Valentin ..... 123/46 R
2001/0004442 A1 * 6/2001 Elliott-Moore ..... 417/225

* cited by examiner

*Primary Examiner*—Teresa Walberg
*Assistant Examiner*—L Fastovsky
(74) *Attorney, Agent, or Firm*—John S. Artz

(57) ABSTRACT

An air booster system (10) for use with a gas turbine to deliver compressed air to a combustion chamber (14) includes a first cylinder (24) with a first piston (52) reciprocal therein and a second cylinder (26) having a second piston (54) reciprocal therein. The first piston (52) is connected to the second piston (54) by a connecting rod (56) such that the first and second pistons (52, 54) reciprocate together. The air booster system (10) also includes a third cylinder (28) having a third piston (58) reciprocal therein and a fourth cylinder (30) having a fourth piston (60) reciprocal therein. The third piston (58) is connected to the fourth piston (60) by a connecting rod (62) such that the third piston (58) and the fourth piston (60) reciprocate together. Each of the cylinders (24, 26, 28, 30) are in fluid communication with a compressor (12) to receive preliminarily compressed air therefrom. The second cylinder (26) and the fourth cylinder (30) are also in communication with a reservoir (20) to deliver highly compressed air thereto. The first cylinder (24) is in fluid communication with the fourth cylinder (30). The third cylinder (28) is in fluid communication with the second cylinder (26).

24 Claims, 3 Drawing Sheets

HIGH EFFICIENCY BOOSTER FOR AUTOMOTIVE AND OTHER APPLICATIONS

TECHNICAL FIELD

The present invention relates to a high efficiency booster for use in applications where a gas turbine is the primary source of power, including hybrid automotive engines as well as other applications.

BACKGROUND ART

Boosters are currently used in applications where a gas turbine is the primary source of power, such as in hybrid automotive engines or in stationary plants for the purpose of increasing the power output of the gas turbine. As is known, a good power producing system is one that has reasonably high thermal efficiency consistent with economical, environmental, and other constraints. However, current technology does not allow the above-mentioned goals to be achieved in a typical four-cycle internal combustion engine, whether for an automotive engine or a stationary plant. This is because current technology provides only limited power output and thus decreased fuel efficiency.

One proposed solution for providing the desired fuel efficiency is through the development of a hybrid form of engine with multiple-fuel usage. This approach would likely require the use of reformulated gasoline, ethanol, methanol, alcohol, natural gas, a combination of fuels, or other fuels as potential primary sources of energy. Other energy sources such as electrical equipment (batteries, electric motors and generators) could optionally make a plant a hybrid power plant.

While hybrid vehicles have many advantages in comparison with conventional ones, employing the internal combustion engine in the hybrid vehicle, however, will not eliminate the problems peculiar to these engines. The primary problems associated with these engines include: pollution as a result of incomplete fuel combustion, the necessity of using only a special type of fuel, such as expensive gasoline or diesel fuels, comparable low thermal efficiency, dynamic loads resulting in more complicated suspension systems, and higher stress on some structural elements.

Electric vehicles have been proposed as a solution to the above problem. However, the major barrier to the immediate introduction of the electric vehicle has been limitations on current battery technology. In considering the efficiency of electric vehicles, the following factors must be taken into account, thermal efficiency of the power plant, losses of energy in transformers, electric power lines, and other losses in additional devices.

Employing an internal combustion engine in the hybrid vehicle would not solve the problems peculiar to these engines. The main problems are: pollution as a result of incomplete combustion of fuel, necessity of using a special type of fuel—expensive gasoline or diesel fuel—comparably low thermal efficiency, dynamic loads resulting in more complicated suspension systems, and higher stress on some structural elements. Another drawback is that a compressor utilized with the gas turbine typically uses a substantial portion of the turbine output power to operate, including as much as 50% or more. Such a configuration clearly could not meet the requirements of the Clean Air Act.

Another possible solution to the problem set forth above is contained in U.S. Pat. No. 4,578,995. The invention disclosed in the '995 patent is particularly applicable to an automotive power plant or engine. It includes an electric motor with a drive shaft connected to a transmission, and a battery pack connected to the motor for driving the transmission at low speeds in urban areas to lessen the pollution. There is also an alternative power source disclosed for use with the motor.

The alternative power source includes an electric generator connected to the motor drive shaft, with power leads connected to the batteries and to the electric motor. The drive shaft is also coupled to an air compressor, which generates pressurized air that is directed into a combustion chamber. The hot gases from the combustion chamber are then passed at a high velocity through a conduit to a gas turbine with an impeller secured to the compressor shaft for transmitting a drive torque thereto and through the coupled motor drive shaft to the vehicle transmission. The turbine is primarily intended for use outside the urban area or for recharging the batteries. The turbine is preferably used when the vehicle is running on full load (for example, loaded and running with high speed). It is adapted to prolong the life of the vehicle batteries if the power source shifts from batteries to the gas turbine. The gas turbine disclosed in the '995 patent has a comparable high thermal efficiency when it operates at full load. However, the efficiency of the gas turbine is drastically reduced at the lower loads than the rated capacity and thus, is inefficient.

SUMMARY OF THE INVENTION

It is thus an object of the present invention to provide a booster system for applications where a gas turbine is used as the primary source of power, which provides higher efficiency.

It is another object of the present invention to provide a hybrid vehicle or stationary plant utilizing a gas turbine that will significantly increase the peak cycle temperature and cycle pressure ratio and thereby improve the cycle thermal efficiency and ease of control of the unit under various loads.

It is yet another object of the present invention to provide a power producing system with high thermal efficiency and reduced emission or air pollution.

It is still another object of the present invention to provide a booster system to increase the efficiency of a compressor based system.

In accordance with the above and other objects of the present invention, an air booster system for use with a gas turbine to deliver compressed air to a combustion chamber is provided. The air booster system includes a first cylinder, having a first piston reciprocal therein, and a second cylinder having a second piston reciprocal therein. The first piston is connected to the second piston by a connecting rod such that the first piston and the second piston reciprocate together. The air booster system also includes a third cylinder having a third piston reciprocal therein and a fourth cylinder having a fourth piston reciprocal therein. The third piston is connected to the fourth piston by a connecting rod such that the third piston and the fourth piston reciprocate together. Each of the cylinders is in fluid communication with a compressor to receive preliminarily compressed air therefrom. The second cylinder and the fourth cylinder are also in communication with a reservoir to deliver highly compressed air thereto. The first cylinder is in fluid communication with the fourth cylinder, and the third cylinder is in fluid communication with the second cylinder.

These and other features of the present invention will become apparent from the following description of the invention, when viewed in accordance with the accompanying drawings and appended claims.

DETAILED DESCRIPTION OF THE DRAWINGS

DETAILED DESCRIPTION OF THE PREFERRED EMBODIMENT

Figure 1:
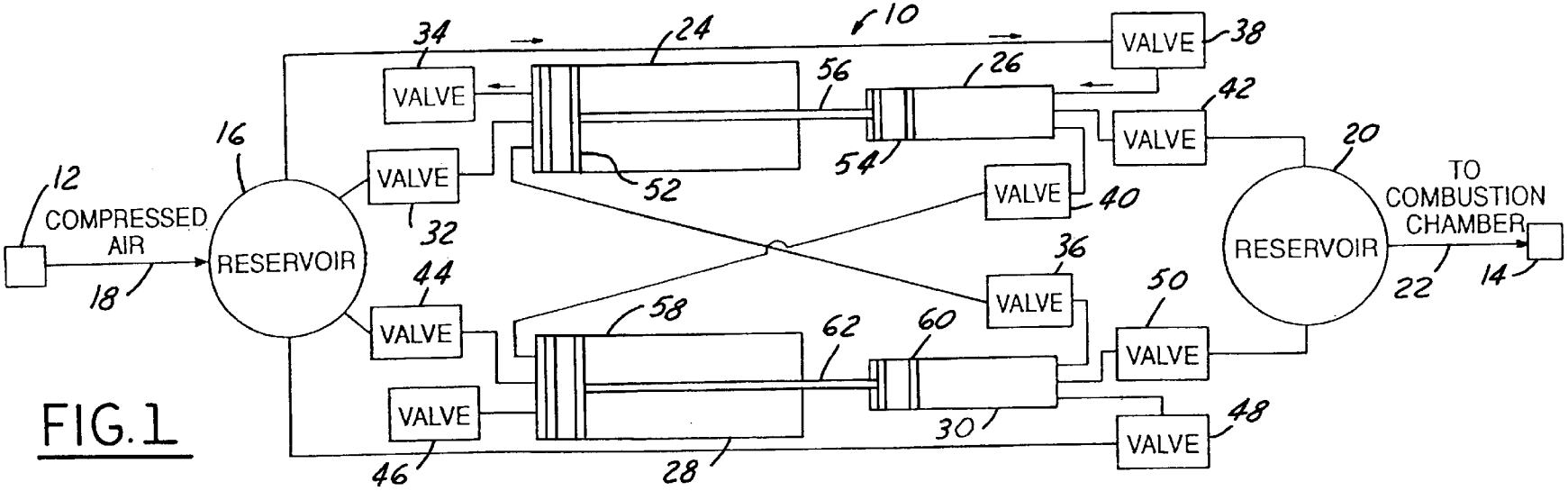
FIG. 1 is a schematic illustration of an initial phase of a booster system in accordance with a preferred embodiment of the present invention.

Referring now to the drawings, a booster system 10 is schematically shown. The booster system 10 is preferably in communication with a compressor 12 to receive preliminarily compressed air therefrom and a combustion chamber 14 to output gas thereto. While the disclosed and described gas is preferably air, it should be understood that the disclosed booster system 10 can be utilized with a variety of other gases. Moreover, the disclosed system 10 can be used in a variety of automotive applications, but may also be used in a variety of non-automotive applications, such as ships, tanks, or other applications involving a gas turbine.

The compressor 12 is in fluid communication with an input reservoir 16 to deliver preliminarily compressed air thereto, as generally indicated by the compressed air input stream 18. The combustion chamber 14 is in fluid communication with an output reservoir 20 to receive boosted air therefrom, as generally indicated by the compressed air output stream 22. The booster system 10 also includes a first cylinder 24, a second cylinder 26, a third cylinder 28, and a fourth cylinder 30. The first cylinder 24 is a power cylinder and is in fluid communication with the input reservoir 16 via a first input valve 32. The first cylinder 24 is also in fluid communication with an exhaust valve 34 and a transfer valve 36 that is disposed between the first cylinder 24 and the fourth cylinder 30. The second cylinder 26 is a delivery cylinder and is in fluid communication with a second input valve 38 that controls the flow of fluid from the input reservoir 16, a transfer valve 40 that is disposed between the second cylinder 26 and the third cylinder 28, and a reservoir valve 42 that is disposed between the second cylinder 26 and the output reservoir 20.

The third cylinder 28, which is also a power cylinder, is in communication with the transfer valve 40, a third input valve 44 which controls the flow of fluid from the input reservoir 16, and an exhaust valve 46. The fourth cylinder 30, which is also a delivery cylinder, is in communication with the transfer valve 36, a fourth input valve 48 that controls the flow of fluid from the input reservoir 16, and a reservoir valve 50 that controls the flow of fluid from the fourth cylinder 30 to the output reservoir 20. The power cylinders and the delivery cylinders have different diameters, namely the diameter of the power cylinder is greater than the diameter of the delivery cylinder, as shown. Moreover, while two pairs of cylinders are disclosed, it should be understood that more pairs may be utilized in accordance with the objects of the present invention.

The first cylinder 24 has a first piston 52 which is reciprocal within the first cylinder 24 between a far right position and a far left position. The terms "left" and "right" as used herein are merely for illustration purposes to assist in understanding the drawings and are not intended to be limiting. The second cylinder 26 has a second piston 54, which is reciprocal within the second cylinder 26 between a far right position and a far left position. The first piston 52 is connected to the second piston 54 by a first connecting rod 56 such that they reciprocate together as a unitary structure. The third cylinder 28 has a third piston 58 which is reciprocal therein between a far right position and a far left position. The fourth cylinder 30 has a fourth piston 60 which is reciprocal therein between a far right position and a far left position. The third piston 58 is connected to the fourth piston 60 by a second connecting rod 62, such that the third piston 58 and the fourth piston 60 reciprocate together as a unitary structure.

FIGS. 1 through 5 illustrate the operation of the booster 10 in accordance with the present invention. In the preferred embodiment, the sequence of operation consists of six (6) individual phases, which are illustrated in FIGS. 1 through 5, respectively. The booster 10 preferably uses reciprocating motion of pistons with the cylinders sharing each other's exhaust air. The disclosed booster 10 provides high efficiency, which is needed for applications where a gas turbine is used as the primary source of power, such as in hybrid automotive engines. The disclosed invention will also permit the use of different kinds of fuels, thus increasing vehicle efficiency, while also reducing air pollution. Further, the disclosed booster also provides the necessary arrangement for charging batteries during the period when the vehicle is running, as will be understood by one of skill in the art. Additionally, the booster allows for the use of the compressor for full but lower capacity. When it becomes necessary to increase the pressure due to the change in load, the booster system 10 acts as a supplement source of compressed air.

Referring now to FIG. 1 which illustrates a first phase of the booster 10 in accordance with the present invention. The booster 10 is preferably operatively connected to a controller which directs the sequence of operation of the booster through its various phases through the actuation of the various valves as is necessary. While a discrete number of values are shown and described, the number of valves is not intended to be limited as more or less valves may be utilized as is necessary. For example, three-way valves or four-way valves could be used to decrease the number of valves. Alternatively, a variety of other known methods and apparatus may be utilized to control the booster and actuate the valves, such as is well known in the art. As shown in FIG. 1, an exhaust valve 34 is opened to the atmosphere and the second input valve 38 is opened to allow preliminarily compressed air from the compressor to flow from the input reservoir 16 and into the second cylinder 26 on the right hand side of the second piston 54. When the second cylinder 26 is filled with preliminarily compressed air from the reservoir 16, the first piston 52 and the second piston 54 are moved to the far left positions. When the first piston 52 and the second piston 54 have reached the far left position shown in FIG. 1, the exhaust valve 34 and the second input valve 38 are each closed.

Figure 2:
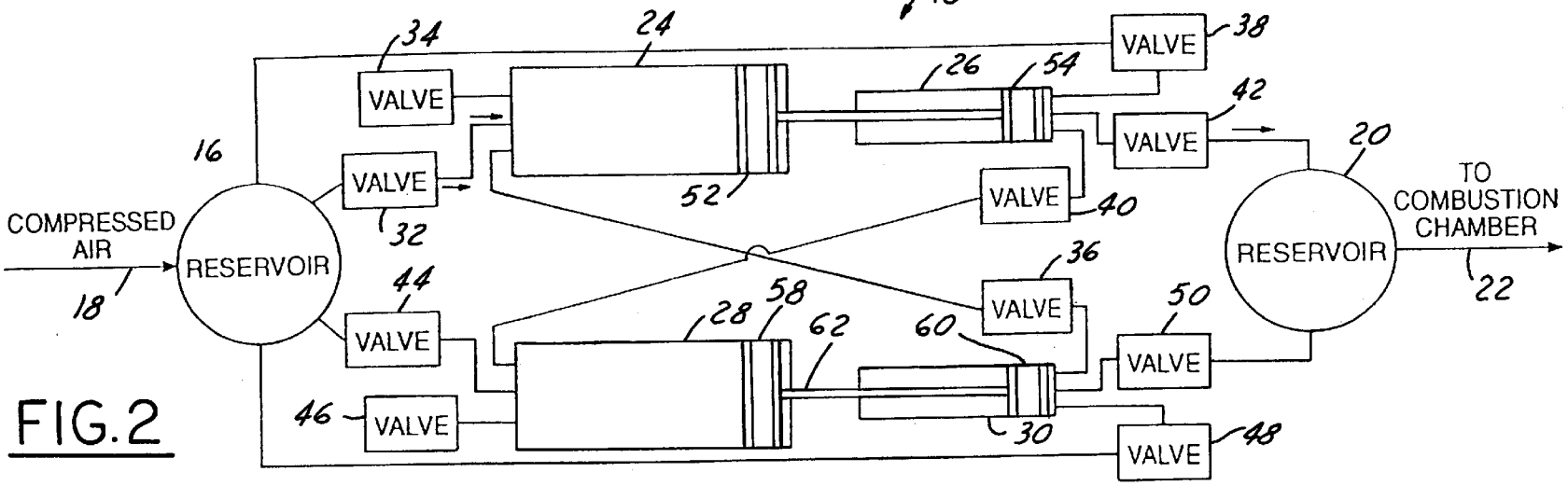
FIG. 2 is a schematic illustration of a second phase of a booster system in accordance with a preferred embodiment of the present invention.

Referring now to FIG. 2, which illustrates a second phase of the preferred booster system 10, the first input valve 32 is opened such that preliminarily compressed air is delivered to the first cylinder 24 on the left hand side of the first piston 52. As the first cylinder 24 is filled, the air in the second cylinder 26 is compressed by the second piston 54 as it is caused to move to the right within the second cylinder 26 by gas entering the first cylinder 24. The amount of air allowed to enter the first cylinder 24 can be varied so as to control the pressure to which the air in the second cylinder 26 is compressed. The exact pressures are not critical to the understanding of the invention, however, it should be understood that the design pressure may be set and varied as necessary. When the air in the second cylinder 26 is compressed to the design pressure as determined by the controller or other known apparatus, the reservoir valve 42 opens to allow compressed air to pass from the second cylinder 26 into the output reservoir 20. After the compressed air has exited the second cylinder 26, both the first input valve 32 and the reservoir valve 42 are closed. At this point, both the first piston 52 and the second piston 54 are in the far right position, as illustrated in FIG. 2, with the first cylinder 24 being filled with preliminarily compressed air.

Figure 3:
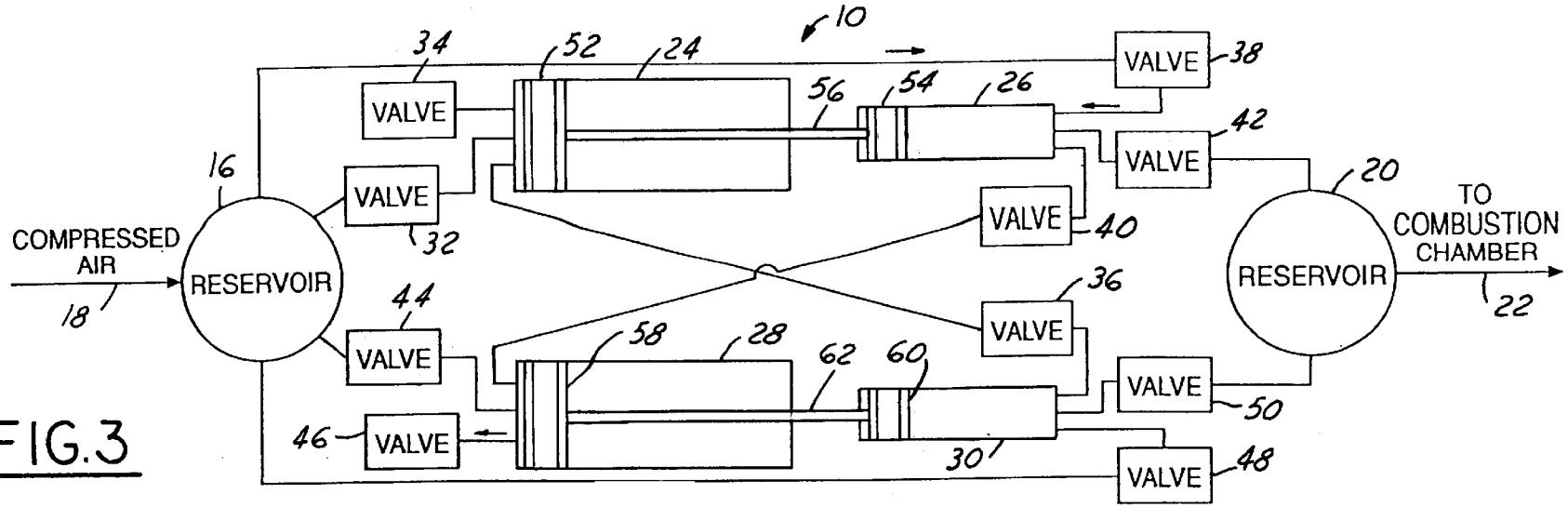
FIG. 3 is a schematic illustration of a third phase of a booster system in accordance with a preferred embodiment of the present invention.

FIG. 3 illustrates a third phase of the proposed booster system 10 in accordance with the preferred embodiment of the present invention. As shown in FIG. 3, the exhaust valve 46 is opened to atmosphere, and simultaneously, the second input valve 38 is opened to fill the second cylinder 26 with preliminarily compressed air. At the same time, the transfer valve 36 is opened allowing air from the first cylinder 24 to evacuate and fill the fourth cylinder 30. Thereafter, the transfer valve 36 and the exhaust valve 46 are closed and the exhaust valve 34 is opened to atmosphere. After both the first piston 52 and the second piston 54 reach the far left position, as shown in FIG. 3, the exhaust valve 34 and the second input valve 38 are closed. During this phase, the third piston 58 and the fourth piston 60 are also located in the far left positions in their respective cylinders 28 and 30.

Figure 4:
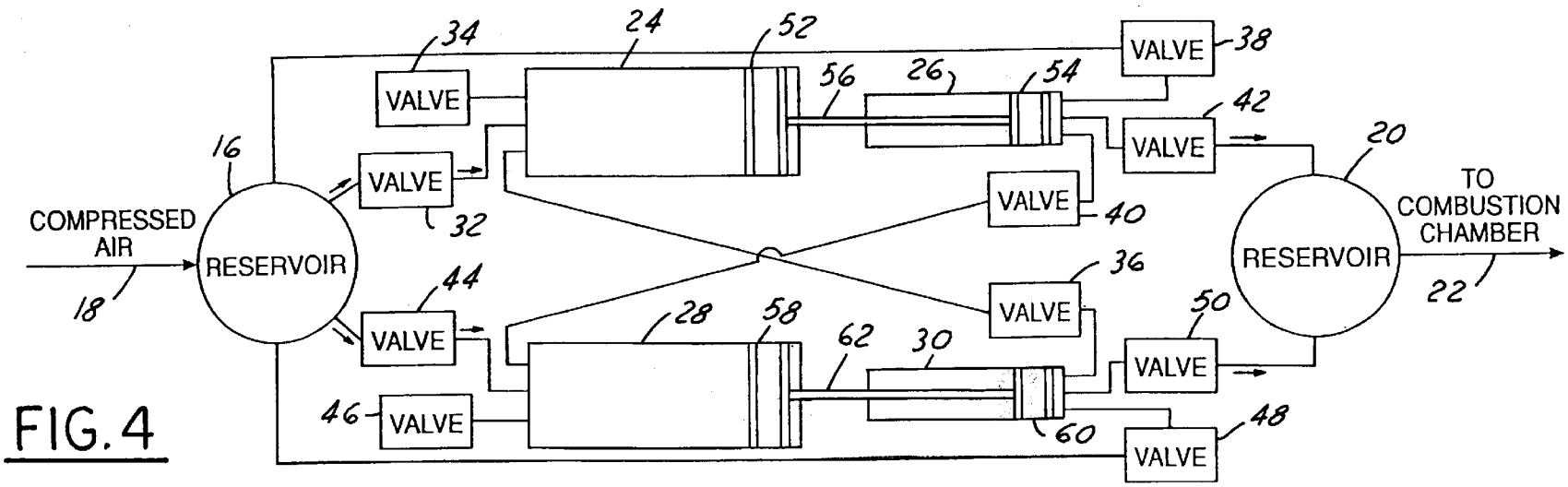
FIG. 4 is a schematic illustration of a fourth phase of a booster system in accordance with a preferred embodiment of the present invention.

Referring now to FIG. 4, which illustrates a fourth phase of the booster system 10, the first input valve 32 and a third input valve 44 are opened to deliver preliminarily compressed air from the input reservoir 16 to both the first cylinder 24 and the third cylinder 28. The air entering the first cylinder 24 and the third cylinder 28 causes the pistons 52, 54, 58, 60 to move to the right. When the gas in the second cylinder 26 and the fourth cylinder 30 reaches their desired pressure, the reservoir valve 42 and the reservoir valve 50 are opened to deliver compressed air to the output reservoir 20. After all four pistons 52, 54, 58, 60 have reached the far-right position, all valves are closed and the booster system 10 is in the position as illustrated in FIG. 4.

Figure 5:
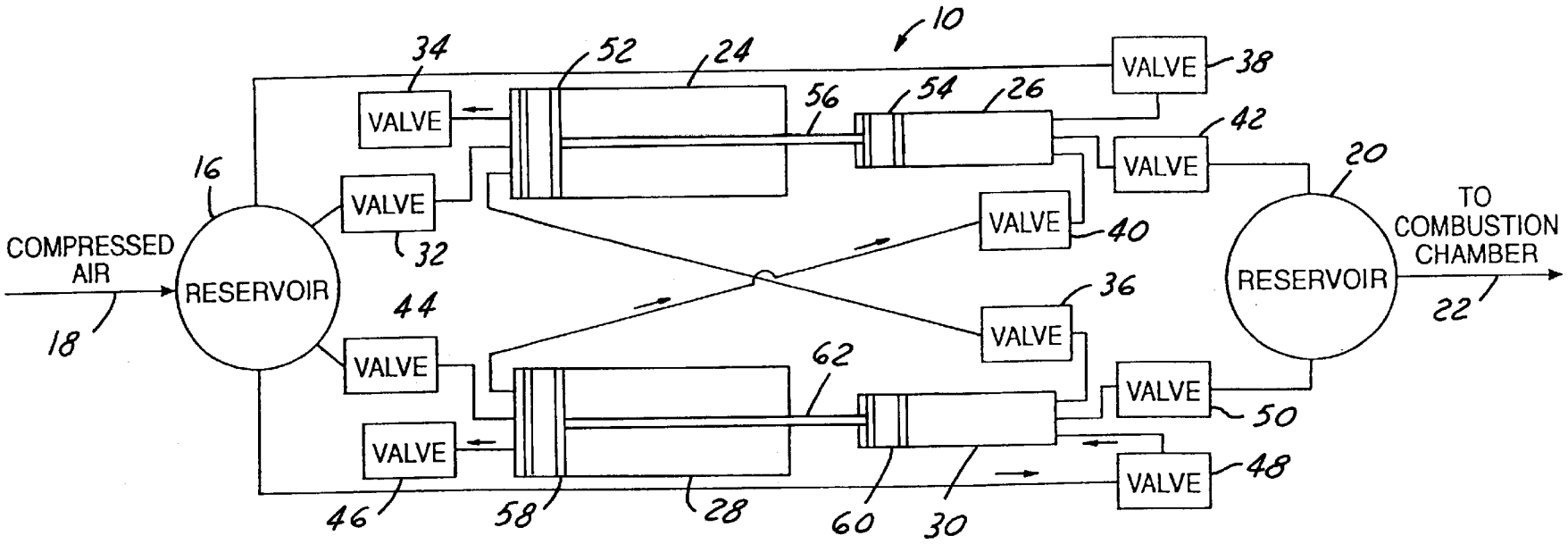
FIG. 5 is a schematic illustration of a fifth phase of a booster system in accordance with a preferred embodiment of the present invention.

Referring now to FIG. 5, which illustrates the fifth phase of the booster system 10 in accordance with the preferred embodiment of the present invention, the exhaust valve 34, the fourth input valve 48, and the transfer valve 40 are opened simultaneously to allow air to be transferred from the third cylinder 28 to the second cylinder 26 and to fill the fourth cylinders 30 with air. After this has been accomplished, the exhaust valve 34 and the transfer valve 40 are closed. Thereafter, the exhaust valve 46 is opened to release the remaining air in the third cylinder 28 to atmosphere. The fourth input valve 48 and the exhaust valve 46 are then closed. When this phase is concluded, the pistons are in the far left hand position in their respective cylinder, such as is shown in FIG. 5. After the fifth phase is complete, the sequence of steps set forth above for the fourth phase is repeated. Namely, compressed air is delivered to the output reservoir 20 by the second cylinder 26 and the fourth cylinder 50. After the fourth phase has been repeated, the booster system 10 performs a sixth phase whereby the sequencing of steps in the fifth phase is repeated. The sequence of operations (phases) may be alternated and varied from the order in which they are shown and described as the order depends upon the initial position of the pistons. However, the principal object of using the exhaust air of one cylinder to fill out another cylinder remains the same regardless of the initial piston position.

As it follows from this description, there is not any mechanism or device such as, for example, a crankshaft to move the pistons back and forth. The piston motion occurs only by the force created by the compressed air. There is not any device, which restricts the motion of the pistons. To prevent any piston knocking against the cover of the cylinder, damper space is preferably provided in each end of the cylinder. This space is created by compressed air and secured by proper adjustment of the opening and closing of the corresponding valves. To prevent knocking other methods or measures may be used, such as cushions, proximity switches or other known ways.

The benefits of the preferred booster system 10 can be seen from the analysis and calculation set forth below. The analysis below compares the efficiency of a gas turbine only as compared to a gas turbine in connection with the booster system 10 of the present invention. The analysis is based on the consideration of a 90 kW gas turbine output, which is suitable for a mid size car. The preliminary analysis operates based on the following parameters: $D_p$=0.200 m., $D_d$=0.160 m., stroke length L=0.530 m. The design air pressure entering the combustion chamber is P=1216 kPa. (12 atm). The analysis follows the known procedure outlined for air-standard Brayton cycle for a simple gas turbine.

Utilization of Gas Turbine Only

In the example, using the gas turbine only, air enters the compressor at a pressure of $P_1$ (101 kPa) and temperature $T_1$ (288 K). The pressure leaving the compressor is $P_2$ (1216 kPa), and the maximum temperature in the cycle is $T_3$=1372 K. It follows that the pressure ratio is $P_2/P_1$=12. The exit temperature $T_2$ of the compressor can then be determined by the following equation:

$$\begin{aligned} T_2 &= T_1\left(\frac{P_2}{P_1}\right)^{(k-1)/k} \\ &= 288\left(\frac{1216}{101}\right)^{(1.4-1)/1.4} \\ &= 607\ \text{K} \end{aligned}$$

The compressor work is determined by the following equation:

$$\begin{aligned} w_c &= C_p(T_2 - T_1) \\ &= 1.0035(607 - 288) \\ &= 319\ \text{kJ/kg} \end{aligned}$$

The exit temperature of the turbine ($T_4$) is determined by the following equation:

$$\begin{aligned} T_4 &= \frac{T_3}{(P_3/P_4)^{(k-1)/k}} \\ &= \frac{1372}{(1216/101)^{(1.4-1)/1.4}} \\ &= 674\ \text{K.} \end{aligned}$$

Note: $P_3/P_4 = P_2/P_1$

The turbine work is determined by the following equation:

$$w_t = C_p(T_3 - T_4)$$
$$= 1.0035(1372 - 674)$$
$$= 701 \text{ kJ/kg}$$

Hence: $\frac{w_c}{w_t} = \frac{319.4}{701.4} = 0.455$ or 45.5%.

As is known, the higher the compression ratio the higher the overall thermal efficiency of the system. However, the design delivery pressure of 12.0 atm (1216 kPa) and hence the pressure ratio of 12 would require multiple staging of the centrifugal compressor since the current technology limits a single phase compressor ratio to about 9.5.

As will be understood, the addition of a regenerator significantly increases the thermal efficiency. However, increasing the pressure ratio in this case leads to a reduction in the thermal efficiency when the pressure ratio is greater than that without a regenerator. Thus, it has been shown that to obtain the desired high thermal efficiency, the pressure ratio of the compressor itself should be reduced, and another device with much higher efficiency should be added as the second phase.

Utilization of Gas Turbine and Proposed Booster

In the example using a gas turbine with disclosed booster 10 system, the data for the compressor is as follows: $P_1$=101 kPa., $T_1$=288 K, $P_2$=810 kPa, and $T_3$=1372 K. Hence the compression ratio is 8. Using the equations set forth above: $T_2$=522 K., and the compressor work $w_c$=242 kJ/kg as compared with $w_c$=319 kJ/kg. This reduces the compressor work to 34.5%.

In this example, the data for the booster is as follows: air enters the booster at $P_5$=810 kPa., $T_5$=607 K., the exit pressure is $P_6$=1216 kPa. The actual temperature of the air entering the booster is less than that because the compressor is preferably equipped with a cooling system and assuming $T_5$=300 K.

The following equation is used to determine the work to compress air in the compressor:

$$w_{rc} = -\int_{P_5}^{P_6} v\,dP \tag{1}$$

The adiabatic compression process is described by the equation:

$$PV^k = P_5V_5^k$$

From which the following equation is obtained:

$$v = v_5\left(\frac{P_5}{P}\right)^{1/k} \tag{2}$$

Inserting equation (2) into equation (1) and integrating, the following is reached:

$$w_{rc} = -\frac{k}{k-1}P_5v_5\left[\left(\frac{P_6}{P_5}\right)^{\frac{k-1}{k}} - 1\right] \tag{3}$$
$$= -\frac{k}{k-1}RT_5\left[\left(\frac{P_6}{P_5}\right)^{\frac{k-1}{k}} - 1\right]$$

From equation (3), the work for air (R=0.287 kJ/kg K) is obtained as follows:

$$w_{rc} = -\frac{1.4}{1.4-1}(0.287)(300)$$
$$\left[\left(\frac{1216}{810}\right)^{\frac{1.4-1}{1.4}} - 1\right] = 37 \text{ kJ/kg}$$

This work is part of the compressor work not turbine work. The calculation shows that more than 65% of the air is utilized in the booster if a four cylinder booster is used. Hence, only this portion of booster work should be taken into account when calculating the amount of work lost, this is $w_{rc}$=37×0.35=13 kJ/kg. Hence, the utilization of both a gas turbine and the proposed reciprocal compressor to compress air from 101 kPa to 1215 kPA requires the following total work:

$$w_{tot} = w_c + w_{rc}$$
$$= 242 + 13.0$$
$$= 255 \text{ kJ/kg},$$

and $wt_{tot}/w_t = 255_1/701 = 0.3642$ or 36.4%.

The exemplary calculation also shows that the friction losses in the reciprocating piston type compressor are about 0.5% which is in concurrence with literature data. As can be seen, the disclosed booster system 10 using the exhaust air of one cylinder to fill out another cylinder significantly reduces the total compressor work. As shown above by the exemplary calculations, the use of the disclosed four cylinder configuration allows up to 65% of the air to be utilized. The use of a booster with two triplex cylinders can increase this number up to 100%. Thus, the only additional work required from the turbine compressor is work associated with friction losses which are negligible. This is true whether the booster is used for a vehicle or a stationary power engine. Alternatively, frictionless pistons, such as ones known in the art, can also be utilized.

Having now fully described the invention, it will be apparent to one of ordinary skill in the art that many changes and modifications can be made thereto without departing from the spirit or scope of the invention as set forth herein.

What is claimed is:

1. A method for providing a high efficiency booster comprising:

emptying substantially a first power cylinder of any air;

filling a first delivery cylinder with preliminarily compressed air from a compressor, such that a first delivery piston is urged to one end of said first delivery cylinder;

compressing said preliminarily compressed air in said first delivery cylinder by filling a first power cylinder with preliminarily compressed air causing said first delivery piston to move away from said one end of said first delivery cylinder;

expelling said compressed air from said first delivery cylinder to a reservoir;

filling said first delivery cylinder with preliminarily compressed air from said compressor such that said first delivery cylinder is urged to said one end of said first delivery cylinder;

filling a second delivery cylinder with preliminarily compressed air from said first power cylinder such that a second delivery piston is urged to one end of said second delivery cylinder;

compressing said preliminary compressed air in both said first delivery cylinder and said second delivery cylinder; and expelling said compressed air from both said first and second delivery cylinders to said reservoir.

2. The method of claim 1, wherein said booster is in fluid communication with a compressor to receive preliminarily compressed air therefrom.

3. The method of claim 2, wherein said booster is in fluid communication with a combustion chamber to transfer compressed air thereto.

4. The method of claim 3, wherein said booster is incorporated into a vehicle engine.

5. The method of claim 3, wherein said booster is incorporated into a stationary power engine.

6. The method of claim 1, further comprising:

a first power piston reciprocal within said first power cylinder, with said first power piston being connected to said first delivery piston such that said first power piston and said first delivery piston reciprocate together.

7. The method of claim 6, further comprising:

a second power cylinder having a second power piston reciprocal therein, with said second power piston being connected to said second piston delivery such that said second power piston and said second delivery piston reciprocate together.

8. An air booster system with increased efficiency, comprising:

a first power cylinder, having a first power piston reciprocal therein;

a first delivery cylinder, having a first delivery piston reciprocal therein, said first power piston connected to said first delivery piston by a connecting rod such that said first power piston and said first delivery piston reciprocate together;

a second power cylinder having a second power piston reciprocal therein;

a second delivery cylinder having a second delivery piston reciprocal therein, said second delivery piston connected to said second power piston by a connecting rod such that said second delivery piston and said second power piston reciprocate together;

a compressor in communication with each of said cylinders to deliver preliminarily compressed air thereto; and a reservoir in communication with said first and second delivery cylinders to receive compressed air therefrom.

9. The booster system of claim 8, wherein in a first phase, said first power piston and said first delivery piston are located at one end of their respective cylinders due to the entry of preliminarily compressed air into said second cylinder through the opening of a second input valve.

10. The booster system of claim 9, wherein in a second phase preliminarily compressed air is passed through a first input valve into said first power cylinder at said end of said cylinder to urge said first power piston toward the other end thereby compressing said preliminarily compressed air in said first delivery cylinder.

11. The booster system of claim 10, wherein a reservoir valve is in communication with said first delivery cylinder to allow said compressed air to flow to said reservoir.

12. The booster system of claim 11, wherein in a third phase said first input valve is opened to allow preliminarily compressed air to enter said first delivery cylinder and a transfer valve is opened to allow said preliminarily compressed air to flow from said first power cylinder to said second delivery cylinder.

13. The booster system of claim 12, wherein in a fourth phase said first input valve and a third input valve are each opened to allow preliminarily compressed air to flow from said compressor to said first power cylinder and said second power cylinder respectively, causing compressed air in said first delivery cylinder and said second delivery cylinder to flow through a respective reservoir valve to said reservoir.

14. The booster system of claim 13, wherein in a fifth phase a fourth input valve is opened to allow preliminarily compressed air to flow from said compressor to said second delivery cylinder while at the same time opening a transfer valve to allow compressed air to flow from said second power cylinder to said first delivery cylinder.

15. The booster system of claim 8, wherein said reservoir is in fluid communication with a combustion chamber to transfer highly compressed air thereto.

16. The booster system of claim 15, wherein the booster is incorporated into a vehicle engine.

17. The booster system of claim 15, wherein the booster is incorporated into a stationary power engine.

18. A booster system for use in delivering compressed air to an engine combustion chamber, comprising:

a first delivery cylinder in communication with a compressor for receiving preliminarily compressed gas therein to reciprocate a first delivery piston to one end of said first delivery cylinder;

a first power cylinder in communication with said compressor for receiving preliminarily compressed gas therein causing a first power piston positioned therein to reciprocate to an end of said first power cylinder;

a rod connecting said first power piston with said first delivery piston such that as said first power piston reciprocates to said end of said first power cylinder, said first delivery piston moves away from said one end to fully compress said preliminary compressed gas;

whereby said first delivery cylinder is in communication with a reservoir to transfer said fully compressed gas thereto.

19. A method for boosting air received from a compressor for delivery to a combustion chamber comprising:

providing a first power cylinder with a first power piston reciprocal therein;

providing a first delivery cylinder with a first delivery piston reciprocal therein, said first delivery piston being connected to said first power piston;

providing a second power cylinder with a second power piston reciprocal therein;

providing a second delivery cylinder with a second delivery piston reciprocal therein, said second delivery piston being connected to said second power piston;

opening a second input valve to allow preliminarily compressed air to flow from an input reservoir to said first delivery cylinder.

20. The method of claim 19, further comprising:

opening a first exhaust valve associated with said first power cylinder to exhaust any air therefrom; and closing said second input valve and said first exhaust valve when said first power cylinder and said first delivery pistons are located at a far end of their respective cylinder.

21. The method of claim 20, further comprising:

opening a first input valve to allow preliminarily compressed air to flow into said first power cylinder thereby compressing said air in said first delivery cylinder;

opening a first reservoir valve after said air in said first delivery cylinder is compressed to the desired pressure to allow said compressed air to flow into an output reservoir; and closing said first input valve and said first reservoir valve after said first delivery cylinder is evacuated.

22. The method of claim 21, further comprising:

opening said second input valve to allow preliminarily compressed air to flow from said input reservoir to said first delivery cylinder;

opening a first transfer valve allowing preliminarily compressed air to flow from said first power cylinder to said second delivery cylinder;

opening a second exhaust valve associated with said second power cylinder to exhaust any air therefrom; and closing said second input valve, said first transfer valve, and said second exhaust valve when said first power cylinder is evacuated of air.

23. The method of claim 22, further comprising:

opening a third input valve to allow preliminarily compressed air to flow into said second power cylinder, thereby compressing air in said second delivery cylinder;

opening said first input valve to allow preliminarily compressed air to flow into said first power cylinder, thereby compressing air in said first delivery cylinder;

opening said first reservoir valve after said air in said first delivery cylinder is compressed to the desired pressure to allow it to flow into said output reservoir; and closing said third input valve, said first input valve and said second output valves when said air in said first and second delivery cylinders is evacuated.

24. The method of claim 23, further comprising:

opening a fourth input valve to allow preliminarily compressed air to flow into said second delivery cylinder;

opening said first transfer valve allowing preliminarily compressed air to flow from said second power cylinder to said first delivery cylinder;

opening said first exhaust valve to exhaust any air in said first power cylinder; and closing said fourth input valve, said first transfer valve and said first exhaust valve when said pistons are located at a far end of said respective cylinders.

* * * * *